US005810460A

United States Patent [19]

Hansen

[11] Patent Number: 5,810,460

[45] Date of Patent: Sep. 22, 1998

[54] SLIP-IN STRUT MODULE FOR FOOD SERVICE CABINET

[75] Inventor: William J. Hansen, Brookfield, Wis.

[73] Assignee: Alto-Shaam, Inc., Menomonee Falls, Wis.

[21] Appl. No.: 861,552

[22] Filed: May 22, 1997

[51] Int. Cl.[6] ..... A47F 3/04

[52] U.S. Cl. ..... 312/139; 16/277; 312/319.2; 312/328

[58] Field of Search ..... 49/463; 16/306, 16/277; 312/138.1, 139, 327, 328, 116, 319.2

[56] References Cited

U.S. PATENT DOCUMENTS

| | | | |
|---|---|---|---|
| 4,842,349 | 6/1989 | Stenemann | 312/139 X |
| 5,112,118 | 5/1992 | Wiehle | 312/116 |
| 5,116,274 | 5/1992 | Artwohl et al. | 312/139 X |

FOREIGN PATENT DOCUMENTS

| | | | |
|---|---|---|---|
| 620996 | 10/1994 | European Pat. Off. | 312/138.1 |
| 3313914 | 10/1984 | Germany | 312/139 |

*Primary Examiner*—Peter M. Cuomo
*Assistant Examiner*—Janet M. Wilkens
*Attorney, Agent, or Firm*—Andrus, Sceales, Starke & Sawall

[57] ABSTRACT

A display case having a tubular framework with a display window pivotally mounted thereto has a lifting and supporting mechanism for the display window including a strut member having a rod end and a cylinder end. A hinge is pivotally mounted to the cylinder and is adapted to be secured to the display window. A strut body slidably receives a strut member and hinge thereon. A retention arrangement pivotally connects the rod end of the strut and the hinge to the strut body so as to define a strut module which is slidable into and out of the tubular framework of the display case.

16 Claims, 2 Drawing Sheets

SLIP-IN STRUT MODULE FOR FOOD SERVICE CABINET

BACKGROUND OF THE INVENTION

This invention relates broadly to a lifting and supporting mechanism for a display window of a food service cabinet and, more particularly, pertains to a fluid cylinder and hinge assembly which is quickly and effectively installed and serviced in the tubular framework of the food service cabinet to open and close the display window.

Food is commonly cooked and/or preserved in a cabinet having treatment spaces with controlled temperature and humidity. The use of these cabinets or display cases has become increasingly popular to preserve a wide variety of foods which must be continuously serviced. In a typical food service cabinet, a glass door or window is hingedly attached about a horizontal axis to the top of the cabinet tubular framework. One method of lifting and supporting this glass door between open and closed positions is to utilize a charged fluid cylinder and hinge assembly which is installed within an upright of the tubular framework. By properly aligning transverse holes formed in the upright with apertures of the fluid cylinder and hinge assembly, screws may be attached from the outer side wall of the tubular framework in order to hold the lifting and supporting mechanism in position.

A problem with a hinge that biases a glass door to an open position utilizing a fluid cylinder is that the fluid cylinder has a relatively limited life span. Typically, after several thousand cycles of opening and closing, the fluid cylinder may fail and need to be replaced. Such replacement becomes nearly impossible when two food service cabinets are placed side-by-side in a manner which makes the installation screws of the fluid cylinder and hinge assembly inaccessible without having to move one of the food service cabinets. A small service job thus becomes a major undertaking because of the size and weight of the food service cabinet. Once the fluid cylinder and hinge assembly has become accessible, care must be taken in removing the installation screws so that the assembly will not fall down into the tubular framework.

What is needed in the art is a fluid cylinder and hinge assembly for a glass window or door of a food service cabinet which may be easily installed and serviced with a minimum of cost and effort.

BRIEF SUMMARY OF THE INVENTION

The present invention advantageously provides a lifting and supporting mechanism for the glass door of a food display case which is extremely accessible, economical to manufacture and easily installed and retrofitted.

One aspect of the invention relates to a display case including a tubular framework having a display window pivotally mounted thereto by means of a hinge and fluid cylinder assembly. The improvement resides in the hinge and fluid cylinder assembly being housed in a module which is slidable into and out of the tubular framework of the display case. The module is retained in the tubular framework by a retainer tab structure formed on the top end of the module and is preferably screwless. The module is accessible at a top end of the tubular framework and the hinge is movable into and out of the module.

Another aspect of the invention relates to a display case including a tubular framework having a display window pivotally mounted thereto. A lifting and supporting mechanism for the display window includes a strut member having a rod end and a cylinder end. A hinge is pivotally connected to the cylinder end and is adapted to be secured to the display window. A strut body slidably receives the strut member and hinge therein and a retention arrangement pivotally connects the rod end of the strut and the hinge to the strut body so as to define a strut module which is slidable into and out of the tubular framework of the display case. The strut module is suspended from the tubular framework and a retention arrangement maintains the rod end and the cylinder end of the strut member inside the strut body. The retention arrangement includes a lower pivot point connecting the rod end of the strut member with the strut body, a first upper pivot point connecting the hinge with the cylinder end of the strut member, and a second upper pivot point connecting the hinge member with the strut body.

In yet another aspect of the invention, a slip-in module for lifting and supporting a glass door of a display case having a tubular framework accessible from an upper end thereof includes a fluid cylinder having a rod end and a cylinder end. A hinge has a first portion adapted to be connected to the glass door, and a second portion pivotally coupled to the cylinder end of the fluid cylinder. A rigid blank material is formed with a first set of spaced openings and a second set of spaced openings, and has a length at least as long as the extended length of the fluid cylinder. The blank is bendable about a pair of lines extending parallel to the longitudinal axis of the blank between the first and second sets of openings to form a fluid cylinder body adapted to receive the fluid cylinder and hinge connected thereto, and having the first set of openings and the second set of openings in alignment, respectively. A first pin passes through the first set of openings and the hinge to define a pivot point for the hinge. A second pin passes through the second set of openings and the rod end of the fluid cylinder to define a pivot point for the fluid cylinder. The fluid cylinder body is slipable into and out of the tubular framework of the display case. The first portion of the hinge is dimensionally sized so as to be supported on a set of walls forming the tubular framework. The fluid cylinder is preferably a nitrogen charged gas cylinder.

Still another aspect of the invention relates to a method for installing a mechanism for lifting and supporting a display window pivotally mounted to the tubular framework of a display case. The method includes the steps of providing a fluid cylinder having a rod end and a cylinder end; pivotally connecting the cylinder end of the fluid cylinder to the hinge to define a fluid cylinder and hinge assembly; providing a strut body for receiving the fluid cylinder and hinge assembly; slidably positioning the fluid cylinder and hinge assembly in the strut body; pivotally connecting the rod end of the fluid cylinder to the strut body; pivotally connecting the hinge to the strut body to define a strut module; sliding the strut module into the tubular framework of the display case; and connecting the display window to the hinge.

Various other objects, features and advantages of the invention will be made apparent from the following description taken together with the drawings.

BRIEF DESCRIPTION OF THE SEVERAL VIEWS OF THE DRAWINGS

The drawings illustrate the best mode presently contemplated of carrying out the invention. In the drawings.

DETAILED DESCRIPTION OF THE INVENTION

Figure 1:
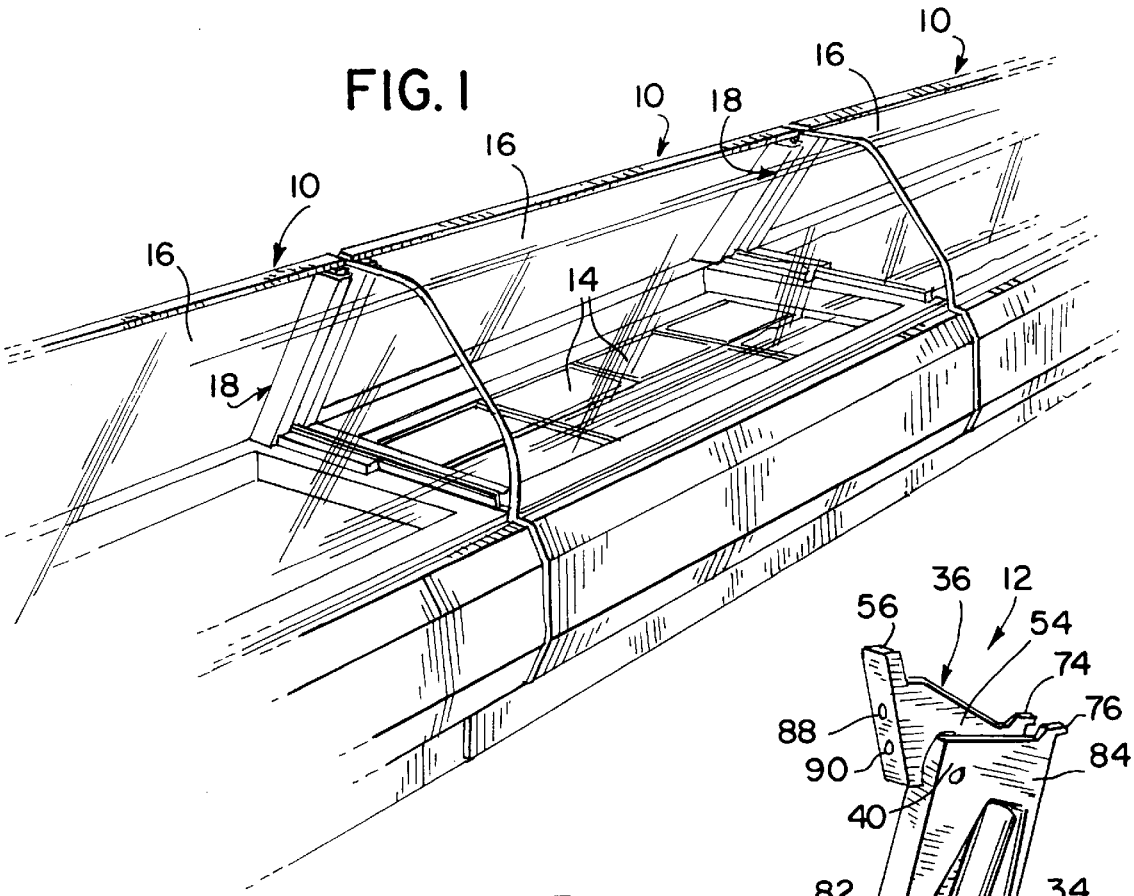
FIG. 1 is a partial, perspective view of several side-by-side food service cabinets or display cases embodying the strut module of the present invention.

Referring now to FIG. 1, there is shown a series of adjacently disposed food service cabinets or display cases 10 embodying the lifting and supporting mechanism 12 of the present invention. As is well known, each of the display cases 10 is used to display a variety of foodstuffs in supermarkets, pastry shops, delicatessens, restaurants and like establishments. Each case 10 holds a plurality of trays 14 of food which are viewed by customers through a glass window 16 forming a customer side of the case 10, and serviced by food handlers from an opposite or service side of the case 10. The framework of each case 10 includes a pair of substantially parallel, upwardly and forwardly inclined tubular support members 18 which normally carry the mechanism 12 for raising and lowering the glass window 16 about a horizontal axis at the upper end of the support members 18. Each tubular support member 18 includes a front wall 20, a rear wall 22 and a pair of connecting sidewalls 24, 26. In the preferred embodiment, a center wall 28 is added for reinforcement and divides the inside of the tubular member 18 into two chambers 30, 32.

In accordance with the invention, each lifting and supporting mechanism 12 comprises a fluid cylinder or strut 34, a hinge 36, a strut body 38 and a retention arrangement in the form of two pivot pins 40, 42 for defining a strut module 44 which is slidable into and out of the top end of each tubular support member 18.

Figure 4:
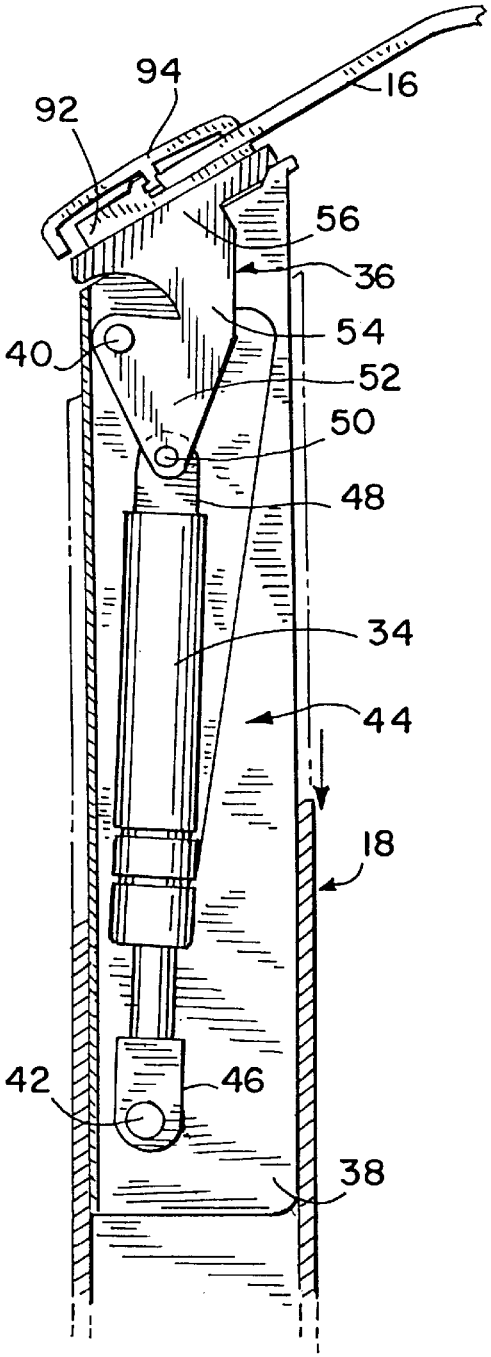
FIG. 4 is a partial, sectional view showing the partially installed strut module with the attached glass door in a closed or lowered position.
Figure 5:
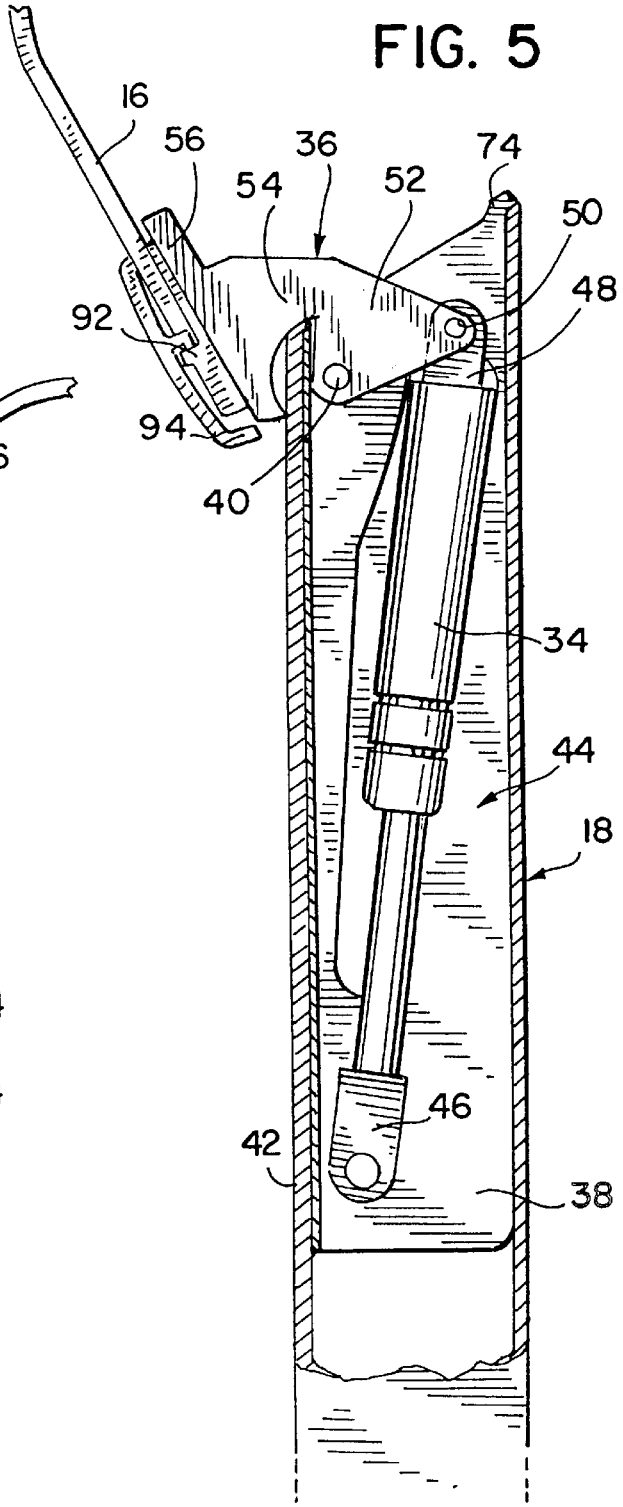
FIG. 5 is a partial, sectional view showing the fully installed strut module with the attached glass door in an open or raised position.

As seen best in FIGS. 4 and 5, the strut 34 is preferably a charged gas cylinder having a rod end 46 and a cylinder end 48 which is normally pivotally attached by a pin 50 passing through a suitable first opening formed in the bottom portion of the hinge 36 to form a fluid cylinder and hinge assembly. The hinge 36 is irregularly shaped and includes a lower, generally triangularly-shaped portion 52, a thickened neck portion 54 and a flattened, upper face portion 56 which is adapted to be connected to a marginal portion of the glass window 16. The lower triangularly-shaped portion 52 includes a floating pivot defined by the pin 50 and a fixed pivot to be described hereafter.

Figure 2:
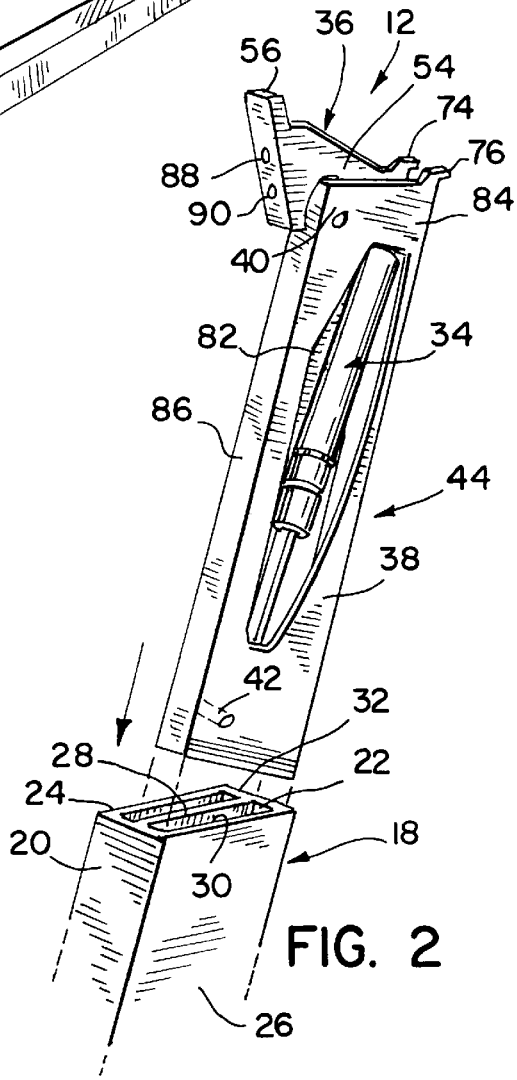
FIG. 2 is a partial, perspective view of a strut module being installed in the tubular framework of a display case.
Figure 3:
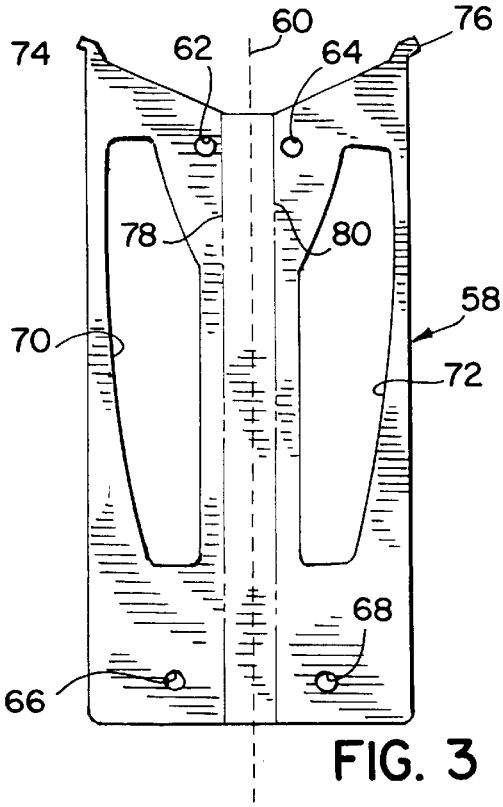
FIG. 3 is a plan view of a blank used to form a strut body.

Referring now to FIGS. 2 and 3, the strut body 38 is comprised of a rigid, bendable, metallic blank 58 having a length at least as long as the extended strut 34. The blank 58 is generally symmetrical about a longitudinal axis 60 bisecting the blank into two halves. The blank 58 is formed with an upper pair of spaced openings 62, 64, and a lower pair of spaced openings 66, 68. Large relief openings 70, 72 are cut into each half of the blank 58 through which the strut 34 may be observed. A pair of opposed tabs 74, 76 is formed on the outer, upper comer of the blank 58 to retain lifting and supporting mechanism 12 relative to the tubular framework member 18. The blank 58 is bent about a pair of lines 78, 80 extending parallel to and on either side of the longitudinal axis 60 between the openings 62, 64 and 66, 68 to form the fluid cylinder or strut body 38. Once formed, the strut body 38 has a pair of spaced sidewalls 82, 84 and a bridging wall 86. Each set of openings 62, 64 and 66, 68 at the top and bottom of the strut body 38 lie in registry or alignment with one another.

The fluid cylinder and hinge assembly is slidably accommodated in a channel formed between the sidewalls 82, 84 of the strut body 38. The first cylindrical pivot pin 40 is passed through the upper set of openings 62, 64 and a suitable second opening spaced from the first opening in the lower portion of the hinge 36. The second cylindrical pivot pin 42 is passed through the lower set of openings 66, 68 and the rod end 46 of the strut 34. The pivot pins 40, 42 act as a retention arrangement for holding the strut 34, the hinge 36 and the strut body 38 together to create the strut module 44.

As a salient feature of the invention, the bottom of the strut module 44 is placed over the top of the tubular support member 18, as shown in FIG. 2, and the module 44 is simply slipped into one of the chambers 30 and moved downwardly with the aid of gravity until the tabs 74, 76 engage the top of the rear wall 22 of the support member 18. With the strut module 44 suspended in the tubular support member 18, the hinge 36 protrudes from the top thereof. The upper face portion 56 presents a set of threaded bores 88, 90 which cooperate with a glass clamp 92 to receive a set of screwthreaded fasteners (not shown) for attaching a marginal portion of the glass door 16 to the hinge 36. A decorative cap 94 is secured over the fasteners to give the display case 10 a smooth, continuous upper contour.

FIG. 4 depicts the strut module 44 in a partially installed position with the glass door 16 attached and held in a slightly raised position. It is noted that the upper face portion 56 of the hinge 36 is dimensionally sized so as to be supported on the top walls of the support member 18 when the glass door 16 is closed. FIG. 5 shows the motion of the floating pivot at the cylinder end 48 of the strut 34 as the glass door 16 is pivoted to an open or raised position so as to access the customer side of the display case 10. As the mechanism moves between FIGS. 4 and 5, the neck portion 54 of hinge 36 moves into and out of the strut module 44.

The lifting and supporting mechanism 12 of the present invention may be included in the original design of a display case 10, or may be retrofit to a predecessor style display case 10. In the latter situation, the display case 10 must normally be moved so as to access the screws which are externally threaded into the outer sidewall of the tubular support member 18. Once the original fluid cylinder and hinge assembly is removed, the strut module 44 may be slipped into place and future maintenance will no longer necessitate the moving of the display case 10.

In the preferred embodiment with gravity aiding the disposition of the strut module 44 within the support member 18, the installation is screwless. However, if the strut module 44 is desired to be installed horizontally, such as at the top of the display case 10, a single screw accessible from the front or rear of the display case 10 may be used to fasten the strut module 44 from the exterior of the display case framework.

It should be appreciated that the present invention provides a novel lifting and supporting mechanism 12 for the glass door of a food service cabinet or display case in which the installation and the maintenance of a fluid cylinder and hinge assembly is vastly improved. Unlike the prior arrangements, the lifting and supporting mechanism is accessible from the front or back of the display case without the need in any way to reorient or relocate the display case. When it is desired to service the fluid cylinder and hinge assembly, a single laborer can attend to this maintenance quickly and usually without any special tools except for a screwdriver to unfasten the glass cap. The strut module provides increased reliability for the display case and reflects a savings and the cost of installation and service.

While the invention has been described with reference to a preferred embodiment, those skilled in the art will appreciate that certain substitutions, alterations and omissions may be made without departing from the spirit thereof. For instance, in the preferred embodiment, the fluid cylinder is a nitrogen charged gas cylinder but it should be understood that the fluid cylinder may also be hydraulically operated or otherwise fluid actuated. Accordingly, the foregoing description is meant to be exemplary only, and should not be deemed limitative on the scope of the invention set forth with following claims.

I claim:

1. In a display case including a framework having tubular sections and a display window pivotally mounted thereto by means of a hinge and fluid cylinder assembly, the improvement wherein the hinge and fluid cylinder assembly is housed in a module slidable into and out of one of the tubular sections of the framework of the display case and retained in the one tubular section without fasteners.

2. The improvement of claim 1, wherein the module is retained in the one tubular section by a retainer tab structure formed on a top end of the module.

3. The improvement of claim 1, wherein the module is screwless.

4. The improvement of claim 1, wherein the module is accessible at a top end of the one tubular section.

5. The improvement of claim 1, wherein the hinge is movable into and out of the module.

6. In a display case including a framework having tubular sections and a display window pivotally mounted thereto, a lifting and supporting mechanism for the display window comprising:

a strut member having a rod end and a cylinder end;

a hinge pivotally mounted to the cylinder end and adapted to be secured to the display window;

a strut body slidably receiving the strut member and hinge therein, the strut body having tab structure projecting therefrom; and a retention arrangement pivotally connecting the rod end of the strut member and the hinge to the strut body so as to define a strut module which is slidable into and out of one of the tubular sections of the framework of the display case and retained in the framework by engagement of the tab structure with the one tubular section.

7. The lifting and supporting mechanism of claim 6, wherein the strut module is suspended from the one tubular section.

8. The lifting and supporting mechanism of claim 6, wherein the retention arrangement maintains the rod end and the cylinder end of the strut member inside the strut body.

9. The lifting and supporting mechanism of claim 6, wherein the retention arrangement includes a lower pivot point connecting the rod end of the strut member with the strut body, a first upper pivot point connecting the hinge with the cylinder end of the strut member, and a second upper pivot point connecting the hinge with the strut body.

10. A slip-in module for lifting and supporting a glass door of a display case having a framework of tubular sections accessible from an upper end thereof, the module comprising:

a fluid cylinder having a rod end and a cylinder end;

a hinge having a first portion adapted to be connected to the glass door, and a second portion pivotally coupled to the cylinder end of the fluid cylinder;

a rigid blank material formed with a pair of spaced tabs, a first set of spaced openings and a second set of spaced openings and having a length at least as long as the extended length of the fluid cylinder, the blank being bent about a pair of lines extending parallel to the longitudinal axis of the blank between the pair of tabs, the first set of openings and the second set of openings to form a fluid cylinder body adapted to receive the fluid cylinder and hinge connected thereto, and having the pair of tabs, the first set of openings and the second set of openings in alignment, respectively;

a first pin passing through the first set of openings and the hinge to define a pivot point for the hinge;

a second pin passing through the second set of openings and the rod end of the fluid cylinder to define a pivot point for the fluid cylinder; the fluid cylinder body being slipable into and out of one of the tubular sections of the framework of the display case and retainable in the one tubular section by engagement of the tabs on an end of the tubular section.

11. The slip-in module of claim 10, wherein the first portion of the hinge is dimensionally sized so as to be supported on a set of walls forming the tubular framework.

12. The slip-in module of claim 10, wherein the fluid cylinder is a nitrogen charged gas cylinder.

13. A method for installing a mechanism for lifting and supporting a display window pivotally mounted to a framework of a display case having tubular sections, the method comprising the steps of:

a) providing a fluid cylinder having a rod end and a cylinder end;

b) pivotally connecting the cylinder end of the fluid cylinder to a hinge to define a fluid cylinder and hinge assembly;

c) providing a strut body for receiving the fluid cylinder and the hinge assembly, the strut body having screwless retention structure formed thereon;

d) slidably positioning the fluid cylinder and hinge assembly in the strut body;

e) pivotally connecting the rod end of the fluid cylinder to the strut body;

f) pivotally connecting the hinge to the strut body to define a strut module;

g) sliding the strut module into one of the tubular sections of the framework of the display case;

h) retaining the strut module in the one tubular section by means of the screwless retention structure; and i) connecting the display window to the hinge.

14. In a display case including a tubular framework having a display window pivotally mounted thereto by means of a hinge and fluid cylinder assembly, the improvement wherein the hinge and fluid cylinder assembly is housed in a module slidable into and out of the tubular framework of the display case, wherein the module is retained in the tubular framework by a retainer tab structure formed on a top end of the module.

15. The improvement of claim 14, wherein the module is screwless.

16. In a display case including a tubular framework having a display window pivotally mounted thereto, a lifting and supporting mechanism for the display window comprising:

a strut member having a rod end and a cylinder end;

a hinge pivotally mounted to the cylinder end and adapted to be secured to the display window;

a strut body slidably receiving the strut member and hinge therein; and a retention arrangement pivotally connecting the rod end of the strut member and the hinge to the strut body so as to define a strut module which is slidable into and out of the tubular framework of the display case, wherein the retention arrangement maintains the rod end and the cylinder end of the strut member inside the strut body.

* * * * *